US005388718A

United States Patent [19]

Lo

[11] Patent Number: 5,388,718

[45] Date of Patent: Feb. 14, 1995

[54] BEVERAGE CONTAINER WITH PULL RING

[76] Inventor: Hsin-Hsin Lo, 9, Alley 3, Lane 35, Weitao RD., N. Dis. Taichung, Taiwan, Prov. of China

[21] Appl. No.: 237,165

[22] Filed: May 3, 1994

[51] Int. Cl.[6] ..... B65D 25/10

[52] U.S. Cl. ..... 220/522

[58] Field of Search ..... 220/521, 522

[56] References Cited

U.S. PATENT DOCUMENTS

| | | | |
|---|---|---|---|
| 2,404,496 | 7/1946 | Henin | 220/522 |
| 2,676,078 | 4/1954 | Young | 220/522 |
| 2,802,590 | 8/1957 | Tupper | 220/522 |
| 3,957,653 | 5/1976 | Bleater | 220/522 |
| 5,174,462 | 12/1992 | Hames | 220/522 |

*Primary Examiner*—Joseph Man-Fu Moy

*Attorney, Agent, or Firm*—Larson and Taylor

[57] ABSTRACT

A beverage container is provided with a pull ring attached to the outer surface of the cap thereof and with a gas chamber disposed under the inner surface of the cap thereof. The gas chamber has a top lid provided with a whistling hole and a bottom lid provided with a small hole through which the gas produced by the beverage contained in the beverage container enters the gas chamber. As the pull ring of the beverage container is pulled out, the gas contained in the gas chamber is let out via the whistling hole, thereby producing a clear, loud and whistling sound.

1 Claim, 3 Drawing Sheets

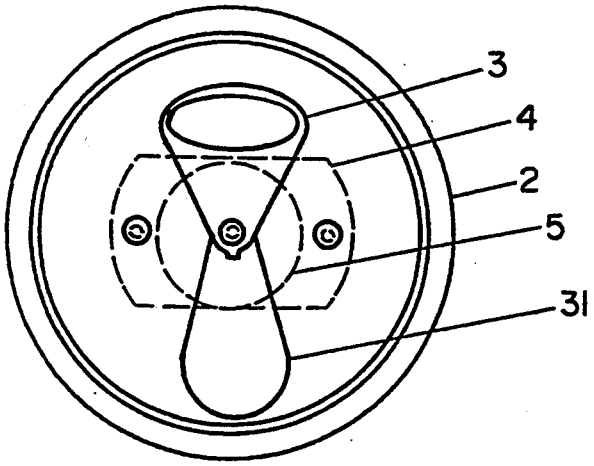
Fig. 2A
Fig. 2B
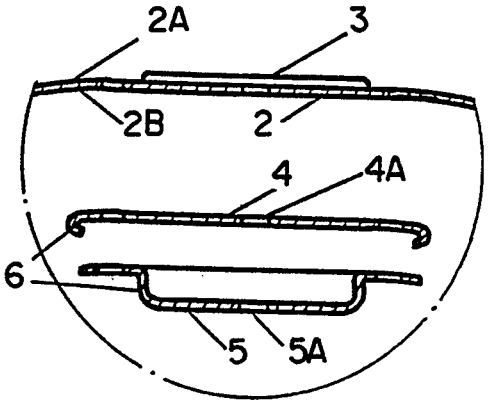
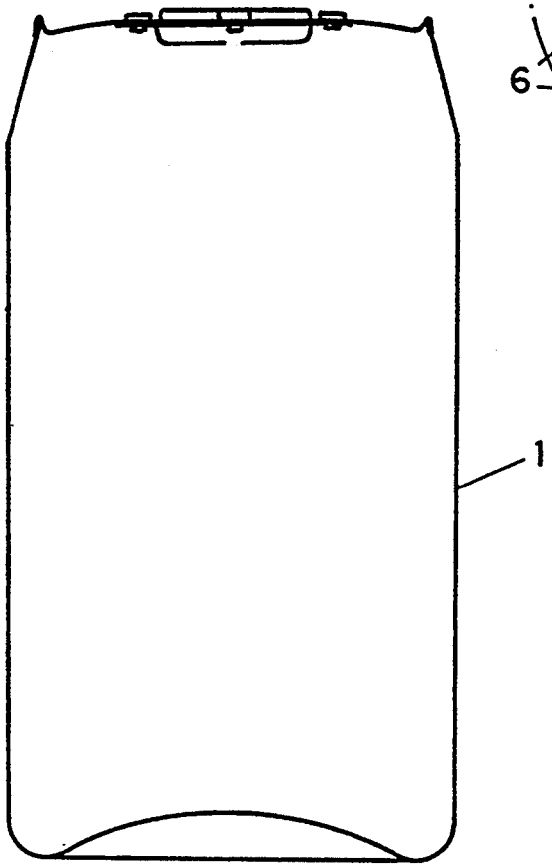
Fig. 2

BEVERAGE CONTAINER WITH PULL RING

BACKGROUND OF THE INVENTION

The present invention relates generally to a beverage container, and more particularly to a beverage container having a top end which is provided with a pull ring to facilitate the opening of the beverage container, It is a well-known fact that a pop sound is produced at the time when the pull ring of the cap of the can containing a carbonated soft drink such as a cola, or an alcoholic beverage like beer, is pulled out. Such a pop sound as described above is short and light and does not give an added exhilarating excitement in drinking, which is a fun thing to do.

SUMMARY OF THE INVENTION

It is therefore the primary objective of the present invention to provide a beverage container capable of producing a clear, loud and whistling sound at the time when the pull ring of the cap of the beverage container is pulled to open, so as to give an added amusement to drinking.

In keeping with the principle of the present invention, the foregoing objective of the present invention is attained by a beverage container which is provided with a pull ring attached to the outer surface of the cap thereof. The gas chamber has a cover provided with a whistling hole and is filled with the gas produced by the beverage held in the body of the beverage container. As the pull ring of the beverage container is pulled out, the gas contained in the gas chamber is let out via the whistling hole, thereby producing a clear, loud and whistling sound.

The foregoing objective, features and structures of the present invention can be more readily understood upon a thoughtful deliberation of the following detailed description of a preferred embodiment of the present invention in conjunction with the accompanying drawings.

BRIEF DESCRIPTION OF THE DRAWINGS

FIG. 2 is an enlarged sectional view showing a body and a gas chamber of the beverage container in combination, according to the present invention as shown in FIG. 1

FIG. 2A is a top plan view of the container of FIG. 1.

FIG. 2B is an enlarged cross-sectional view of a portion of FIG. 2.

DETAILED DESCRIPTION OF THE INVENTION

Figure 1:
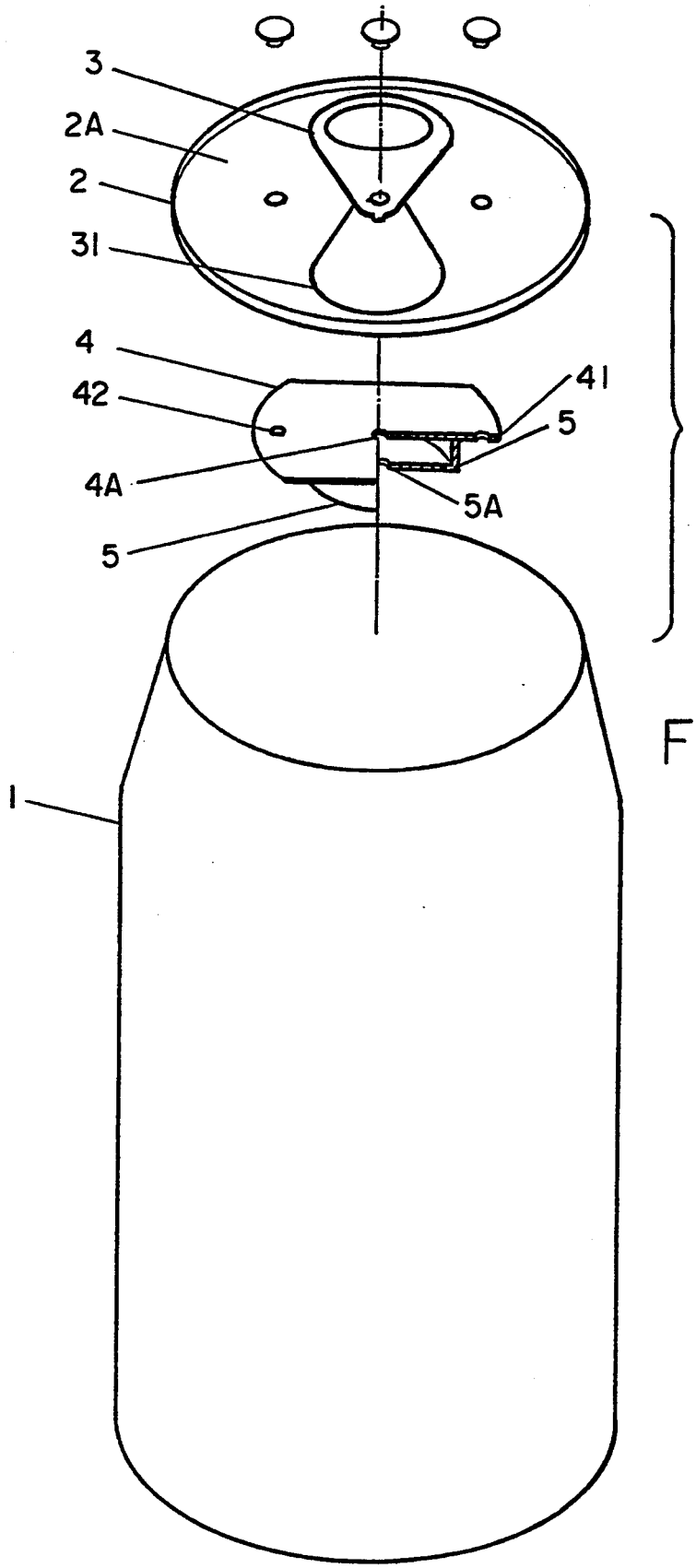
FIG. 1 shows an exploded view of the preferred embodiment of the present invention.

Referring to FIGS. 1, 2, 2A and 2B, the beverage container of the present invention is shown to comprise a body 1 provided with a top end 2 having a pull ring 3 attached to an outer surface 2A thereof and further having a pour opening 31. Disposed horizontally under an inner surface 2B of the top end 2 is a gas chamber 6, which is provided with a top lid 4 and a bottom lid 5. The top lid 4 has a right end 41 and a left end 42, which are riveted respectively to the inner surface 2B of the top end 2. The top lid 4 of the gas chamber 6 is provided at the center thereof with a through whistling hole 4A while the bottom lid 5 of the gas chamber 6 is provided at the center thereof with a small hole 5A through which the gas chamber 6 communicates with the body 1. As a result, the gas produced by the beverage contained in the body 1 is able to enter the sealed gas chamber 6 via the small hole 5A.

Figure 3A:
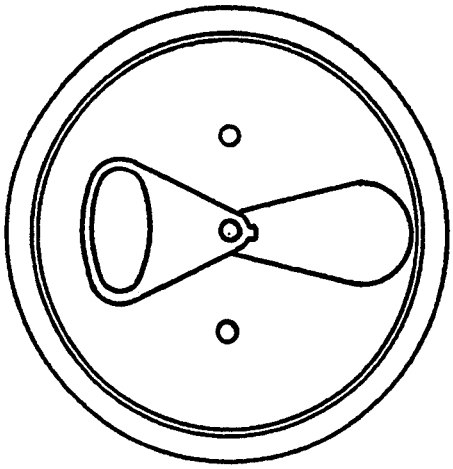
FIG. 3A is a top plan view of FIG. 3.
Figure 3:
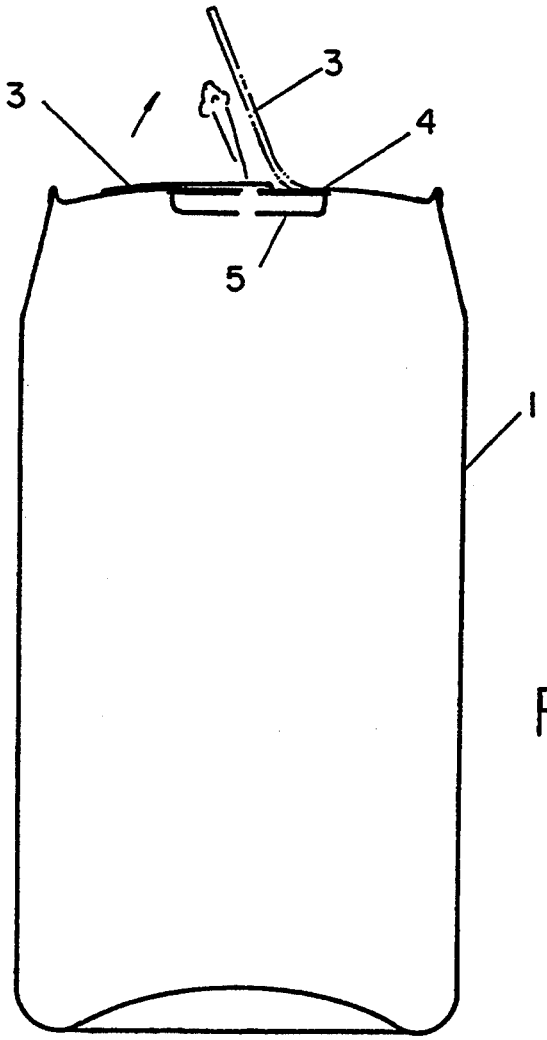
FIG. 3 is a schematic view of the preferred embodiment of the present invention and showing that a pull ring of the beverage container of the present invention is pulled to open the container.

As shown in FIG. 3, as soon as the pull ring 3 pulled out to open up the pour opening 31, a clear, loud and whistling sound is produced by the gas which has already been collected in the gas chamber 6 and is let out via the whistling hole 4A. Such a clear, loud and whistling sound described above gives an added amusement to the joy of drinking. Accordingly, the beverage container of the present invention can be instrumental in promoting the sale of the beverage.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. A beverage container comprising a body provided with a top end having a pull ring attached to an outer surface thereof and further having a pour opening; wherein said top end has an inner surface under which a gas chamber of a dimension and a shape is disposed, said gas chamber having a top lid riveted at a left end thereof and at a right end thereof to said inner surface of said top end, said gas chamber further having a bottom lid, said gas chamber being sealed off except that said top lid of said gas chamber is provided at a center therof with a whistling hole corresponding in location to said pour opening of said top end, and that said bottom of said gas chamber is provided at a center thereof with a small hole through which a quantity of gas produced by a beverage contained in said body is allowed to enter said gas chamber.

* * * * *